US009168630B2

(12) United States Patent
Lee et al.

(10) Patent No.: US 9,168,630 B2
(45) Date of Patent: Oct. 27, 2015

(54) USER-INPUT FUNCTIONS FOR DATA SEQUENCES IN POLISHING ENDPOINT DETECTION

(75) Inventors: Harry Q. Lee, Los Altos, CA (US); Jeffrey Drue David, San Jose, CA (US); Dominic J. Benvegnu, La Honda, CA (US); Boguslaw A. Swedek, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 673 days.

(21) Appl. No.: 13/454,032

(22) Filed: Apr. 23, 2012

(65) Prior Publication Data

US 2013/0280989 A1 Oct. 24, 2013

(51) Int. Cl.

*B24B 37/013* (2012.01)
*B24B 49/12* (2006.01)
*B24B 49/04* (2006.01)

(52) U.S. Cl.

CPC ..... *B24B 37/013* (2013.01); *B24B 49/04* (2013.01); *B24B 49/12* (2013.01)

(58) Field of Classification Search

CPC ..... B24B 37/014; B24B 37/04; B24B 37/12; B24B 49/04; B24B 49/12
USPC ..... 451/5, 6, 8, 41
See application file for complete search history.

(56) References Cited

U.S. PATENT DOCUMENTS 6,271,047 B1 * 8/2001 Ushio et al. ..... 438/14
6,361,646 B1 * 3/2002 Bibby et al. ..... 156/345.1
2002/0042243 A1 * 4/2002 Ihsikawa et al. ..... 451/6
2003/0053042 A1 * 3/2003 Chen ..... 356/73
2005/0026542 A1 * 2/2005 Battal et al. ..... 451/5
2007/0042675 A1 * 2/2007 Benvegnu et al. ..... 451/5
2007/0224915 A1 * 9/2007 David et al. ..... 451/5
2008/0130000 A1 * 6/2008 Benvegnu et al. ..... 356/402
2009/0233525 A1 * 9/2009 Ueda et al. ..... 451/5
2010/0056023 A1 * 3/2010 David et al. ..... 451/5
2010/0114532 A1 * 5/2010 David et al. ..... 702/189
2010/0120331 A1 * 5/2010 Carlsson et al. ..... 451/5
2010/0130100 A1 * 5/2010 David et al. ..... 451/5

(Continued)

FOREIGN PATENT DOCUMENTS

KR 10-2010-0007571 1/2010
KR 10-2011-0113815 10/2011

OTHER PUBLICATIONS

International Search Report and Written Opinion in International Application No. PCT/US2013/034823, mailed Jul. 26, 2013, 9 pages.

*Primary Examiner* — Lee D Wilson
*Assistant Examiner* — Tyrone V Hall, Jr.
(74) *Attorney, Agent, or Firm* — Fish & Richardson P.C.

(57) ABSTRACT

A method of controlling polishing includes receiving user input through a graphical user interface selecting a function, the function including at least one parameter that can be varied, polishing a substrate, monitoring a substrate during polishing with an in-situ monitoring system, generating a sequence of values from measurements from the in-situ monitoring system, fitting the function to the sequence of values, the fitting including determining a value of the at least one parameter that provides a best fit of the function to the sequence of values, determining a projected time at which the function equals a target value, and determining at least one of a polishing endpoint or an adjustment for a polishing rate based on the projected time.

20 Claims, 3 Drawing Sheets

(56) References Cited

U.S. PATENT DOCUMENTS

2010/0217430 A1* 8/2010 David et al. ..... 700/160
2011/0046918 A1* 2/2011 Ravid et al. ..... 702/158
2011/0256805 A1* 10/2011 David et al. ..... 451/5
2011/0301847 A1* 12/2011 David et al. ..... 702/1
2011/0318992 A1* 12/2011 David et al. ..... 451/5
2012/0034845 A1* 2/2012 Hu et al. ..... 451/5
2012/0064801 A1 3/2012 Xu et al.
2012/0278028 A1 11/2012 David et al.

* cited by examiner

USER-INPUT FUNCTIONS FOR DATA SEQUENCES IN POLISHING ENDPOINT DETECTION

TECHNICAL FIELD

The present disclosure relates to monitoring during chemical mechanical polishing of substrates.

BACKGROUND

An integrated circuit is typically formed on a substrate by the sequential deposition of conductive, semiconductive, or insulative layers on a silicon wafer. A variety of fabrication processes require planarization of a layer on the substrate. For example, for certain applications, e.g., polishing of a metal layer to form vias, plugs, and lines in the trenches of a patterned layer, an overlying layer is planarized until the top surface of a patterned layer is exposed. In other applications, e.g., planarization of a dielectric layer for photolithography, an overlying layer is polished until a desired thickness remains over the underlying layer.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. Abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, determining the polishing endpoint merely as a function of polishing time can lead to within-wafer non-uniformity (WIWNU) and wafer-to-wafer non-uniformity (WTWNU).

In some systems, a substrate is optically monitored in-situ during polishing, e.g., through a window in the polishing pad. However, existing optical monitoring techniques may not satisfy increasing demands of semiconductor device manufacturers.

SUMMARY

In some monitoring processes, a linear function is fit to a sequence of values generated by an in-situ monitoring system, e.g., during the polishing processes. For example, a sequence of spectra can be measured in-situ, and a characterizing value can be generated for each spectrum from the sequence. Unfortunately, if the polishing rate is changing gradually as polishing progresses, the linear function may not accurately predict the desired polishing endpoint. In addition, even if the polishing rate is stable, the sequence of values may not be linear. One approach is to permit a user to input a function, and fit the user-input function to the sequence of values. Projection of the user-input function to a target value can provide a more accurate calculation of the time at which the substrate will reach the desired polishing endpoint.

In one aspect, a method of controlling polishing includes receiving user input through a graphical user interface selecting a function, the function including at least one parameter that can be varied, polishing a substrate, monitoring a substrate during polishing with an in-situ monitoring system, generating a sequence of values from measurements from the in-situ monitoring system, fitting the function to the sequence of values, the fitting including determining a value of the at least one parameter that provides a best fit of the function to the sequence of values, determining a projected time at which the function equals a target value, and determining at least one of a polishing endpoint or an adjustment for a polishing rate based on the projected time.

Implementations can include one or more of the following features. Receiving user input may include user input selecting at least one constant in the function. Textual input may be converted to a mathematical function. Receiving user input may include receiving a user selection from a predetermined set of discrete mathematical functions. A plurality of user selections from the predetermined set of discrete mathematical functions may be received to provide the function. The predetermined set of discrete mathematical functions may include one or more of polynomial, exponential, summation, or trigonometric functions. The in-situ monitoring system may be an optical monitoring system, e.g., a spectrographic monitoring system. The measurements may be a sequence of measured spectra. Generating the sequence of values may include identifying a matching reference spectrum from a library of reference spectra, and determining a value associated with the matching reference spectrum. Generating the sequence of values may include identifying a peak or valley in each spectrum of the sequence of measured spectra and determining a value of a width or wavelength of the peak or valley for each spectrum of the sequence of measured spectra. Generating the sequence of values comprises fitting an optical model to each measured spectrum from the sequence of measured spectra, the fitting of the optical model including determining of a value of a parameter of the optical model to provide a best fit of an output spectrum of the model to the measured spectrum.

In another aspect, a non-transitory computer program product, tangibly embodied in a machine readable storage device, includes instructions to carry out the method.

Implementations may optionally include one or more of the following advantages. The user can input a function, which will be fit to the sequence of values from the monitoring system. This permits the endpoint detection system to be adaptable to a wider variety of polishing recipes and applications. The time at which the substrate will reach the desired polishing endpoint can be calculated more accurately. Reliability of the endpoint system to detect a desired polishing endpoint can be improved, and within-wafer and wafer-to-wafer thickness non-uniformity (WIWNU and WTWNU) can be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

A variety of in-situ monitoring techniques can generate a sequence of values that depend on the thickness of a layer on the substrate. As noted above, if the polishing rate is changing gradually as polishing progresses, a linear function may not accurately predict the desired polishing endpoint. In addition, even if the polishing rate is stable, the sequence of values may not be linear.

The polishing system can be configured to permit the user to input a function. Endpoint can be called at the projected time that the user-input function reaches a target value or has changed by a target amount.

The substrate can be as simple as a single dielectric layer deposited on a semiconductor layer, or have a significantly more complex layer stack.

Figure 1:
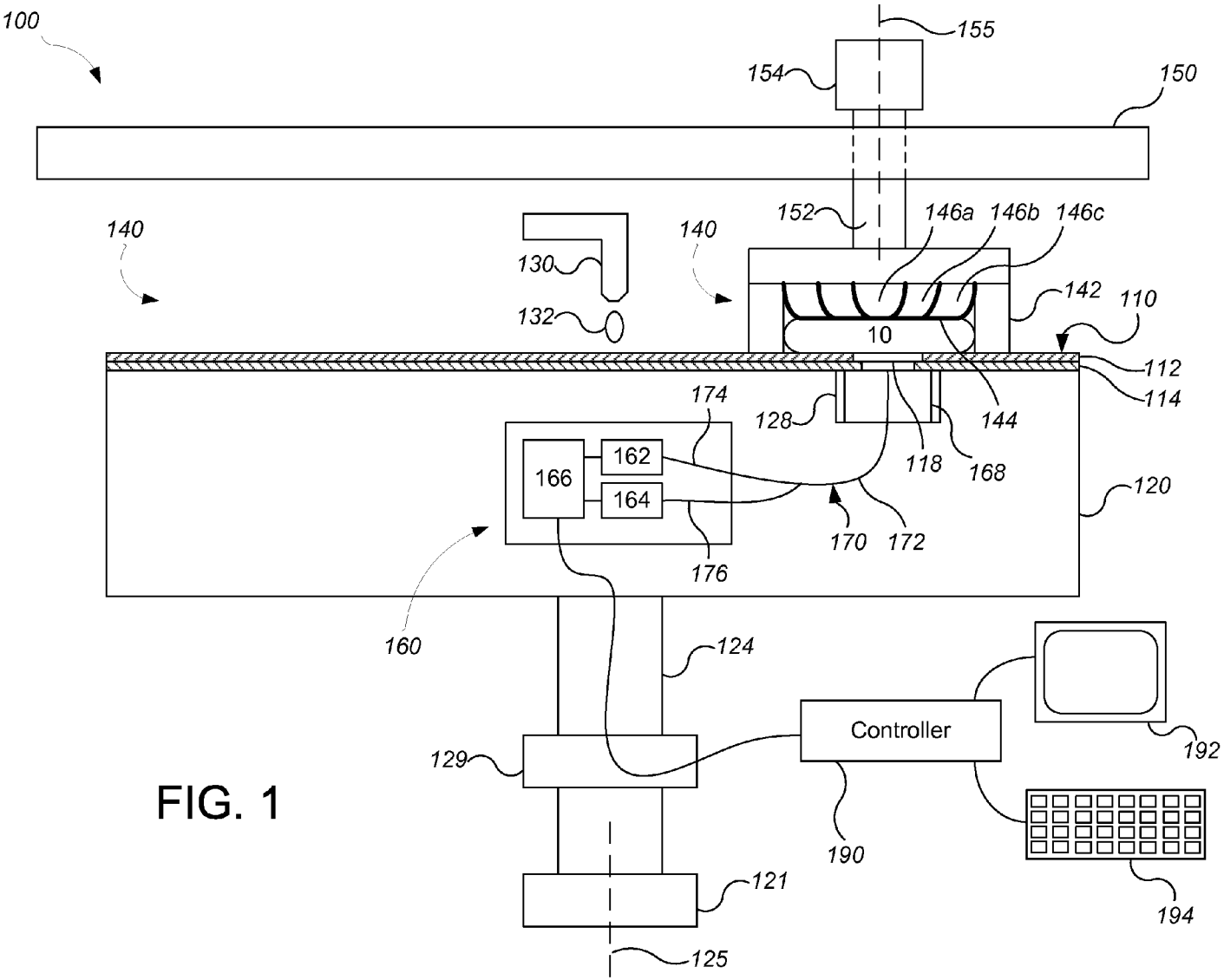
FIG. 1 illustrates a schematic cross-sectional view of an example of a polishing apparatus.

FIG. 1 illustrates an example of a polishing apparatus 100. The polishing apparatus 100 includes a rotatable disk-shaped platen 120 on which a polishing pad 110 is situated.

The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. The carrier head 140 can have independent control of the polishing parameters, for example pressure, associated with each respective substrate.

In particular, the carrier head 140 can include a retaining ring 142 to retain the substrate 10 below a flexible membrane 144. The carrier head 140 also includes a plurality of independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel, and is connected by a drive shaft 152 to a carrier head rotation motor 154 so that the carrier head can rotate about an axis 155. Optionally the carrier head 140 can oscillate laterally, e.g., on sliders on the carousel 150; or by rotational oscillation of the carousel itself. In operation, the platen is rotated about its central axis 125, and the carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

The polishing apparatus also includes an in-situ monitoring system 160. The in-situ monitoring system generates a time-varying sequence of values that depend on the thickness of a layer on the substrate.

For example, the in-situ-monitoring system 160 can be an optical monitoring system. In particular, the in-situ-monitoring system 160 that measures a sequence of spectra of light reflected from a substrate during polishing. One monitoring technique is, for each measured spectrum, to identify a matching reference spectrum from a library of reference spectra. Each reference spectrum in the library can have an associated characterizing value, e.g., a thickness value or an index value indicating the time or number of platen rotations at which the reference spectrum is expected to occur. By determining the associated characterizing value for each matching reference spectrum, a time-varying sequence of characterizing values can be generated. This technique is described in U.S. Patent Publication No. 2010-0217430, which is incorporated by reference. Another monitoring technique is to track a characteristic of a spectral feature from the measured spectra, e.g., a wavelength or width of a peak or valley in the measured spectra. The wavelength or width values of the feature from the measured spectra provide the time-varying sequence of values. This technique is described in U.S. Patent Publication No. 2011-0256805, which is incorporated by reference. Another monitoring technique is to fit an optical model to each measured spectrum from the sequence of measured spectra. In particular, a parameter of the optical model is optimized to provide the best fit of the model to the measured spectrum. The parameter value generated for each measured spectrum generates a time-varying sequence of parameter values. This technique is described in U.S. Patent Application No. 61/608,284, filed Mar. 8, 2012, which is incorporated by reference. Another monitoring technique is to perform a Fourier transform of each measured spectrum to generate a sequence of transformed spectra. A position of one of the peaks from the transformed spectrum is measured. The position value generated for each measured spectrum generates a time-varying sequence position values. This technique is described in U.S. patent application Ser. No. 13/454,002, filed Apr. 23, 2012, which is incorporated by reference.

Other examples of the in-situ-monitoring system 160 include eddy current monitoring systems, capacitive measurement systems, and slurry chemistry monitoring systems.

Assuming that the in-situ-monitoring system 160 is an optical monitoring system, an optical access through the polishing pad can be provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber can include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

Figure 2:
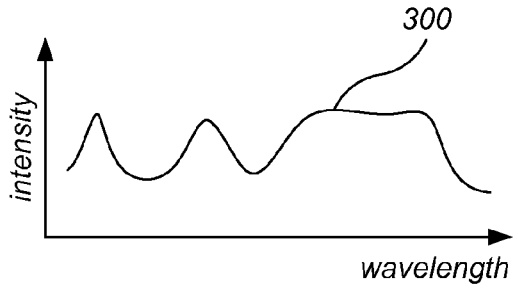
FIG. 2 illustrates a measured spectrum from the in-situ optical monitoring system.

The light source 162 can be operable to emit ultraviolet (UV), visible or near-infrared (NIR) light. The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency). FIG. 2 illustrates an example of a measured spectrum 300 with intensity as a function of wavelength.

As noted above, the light source 162 and light detector 164 can be connected to a computing device, e.g., the controller 190, operable to control their operation and receive their signals. The computing device can include a microprocessor situated near the polishing apparatus. For example, the computing device can be a programmable computer. With respect to control, the computing device can, for example, synchronize activation of the light source with the rotation of the platen 120.

The optical monitoring system 160 is configured to generate a sequence of measured spectra at a measurement frequency. In some implementations, the light source 162 and detector 164 of the in-situ monitoring system 160 are installed in and rotate with the platen 120. In this case, the measurement frequency can be once per rotation of the platen. It is possible for multiple spectra to be obtained as the optical access passes below the substrate 10, in which case one of the obtained spectra can be selected, or multiple obtained spectra can be combined, to provide the measured spectra.

In operation, the controller 190 can receive, for example, a signal that carries information describing a spectrum of the light received by the light detector for a particular flash of the light source or time frame of the detector. Thus, this spectrum is a spectrum measured in-situ during polishing.

Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

The controller 190, e.g., the computing device, can be programmed to perform one monitoring techniques described above to generate the time-varying sequence of values. A display 192, e.g., a LED screen, and a user input device 194, e.g., a keyboard and/or a mouse, can be connected to the controller 190.

Figure 3:
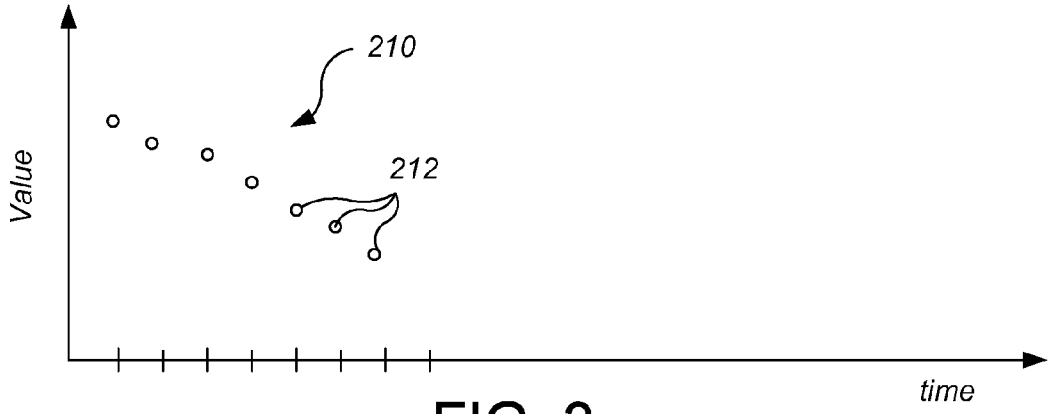
FIG. 3 illustrates a sequence of values generated by the in-situ optical monitoring system.

Referring to FIG. 3, which illustrates the results for only a single zone of a substrate, a time-varying sequence of values 212 is illustrated. This sequence of values can be termed a trace 210. In general, for a polishing system with a rotating platen, the trace 210 can include one, e.g., exactly one, value per sweep of the sensor of the optical monitoring system below the substrate. If multiple zones on a substrate are being monitored, then there can be one value per sweep per zone. Multiple measurements within a zone can be combined to generate a single value that is used for control of the endpoint and/or pressure. However, it is also possible for more than one value to be generated per sweep of the sensor.

Returning to FIG. 1, prior to commencement of the polishing operation, the user can define a function 214 that will be fit to the time-varying sequence of values 212. In particular, the controller 190 can display a graphical user interface on the display 192, and the user can input the user-input function 214 with the user input device 194.

In some implementations, the controller can include equation parsing software that converts textual input into an equivalent mathematical function. In some implementations, the graphical user interface of the equation parsing software permits a user to select from a large number of discrete mathematical functions to assemble the function. The functions can include one or more of polynomials of arbitrary order, exponential, summation, trigonometric functions. The user can identify which portions of the function are constants that cannot be varied when the function is fit to the sequence of values, and which portions of the function are parameters that can be varied to fit the function to the sequence of values.

Figure 4:
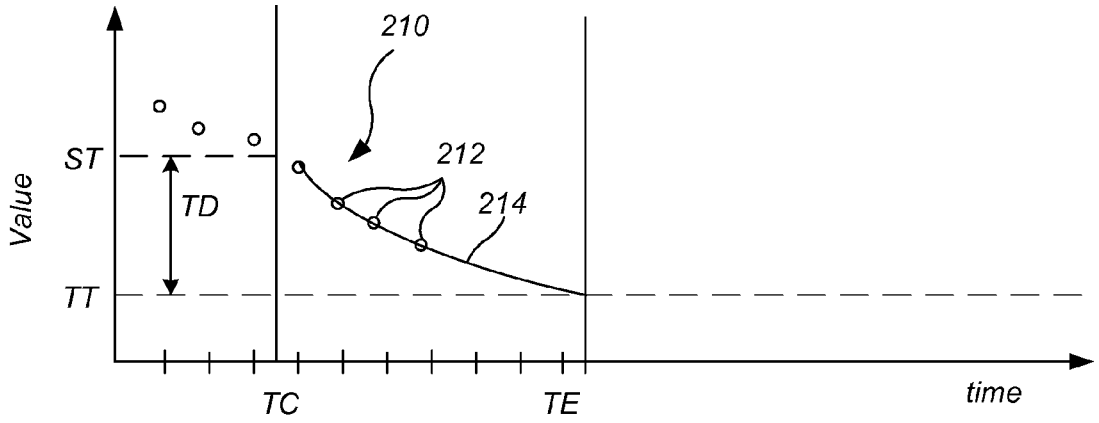
FIG. 4 illustrates a sequence of values having a user-input function fit to the sequence of values.

As shown in FIG. 4, the user-defined function 214 is fit to the sequence of values 212. Multiple techniques exist to fit generalized functions to data. For linear functions such as polynomials, a general linear least squares approach can be employed, e.g., as described in Chapter 15.4 of "Numerical Recipes in C". For non-linear functions, the Levenberg-Marquardt Method is frequently used, e.g., as described in Chapter 15.5 of "Numerical Recipes in C". More robust methods include Simulated Annealing Methods, e.g., as described in Chapter 10.9 of "Numerical Recipes in C". For example, the user-defined function can be converted to a polynomial function, and then the function fitted with a general least squares procedure.

Optionally, the user-defined function can be fit to the values collected after time a TC. Values collected before the time TC can be ignored when fitting the function to the sequence of values. For example, this can assist in elimination of noise in the measured spectra that can occur early in the polishing process, or it can remove spectra measured during polishing of another layer. Polishing can be halted at an endpoint time TE that the function 214 equals a target value TT.

Figure 5:
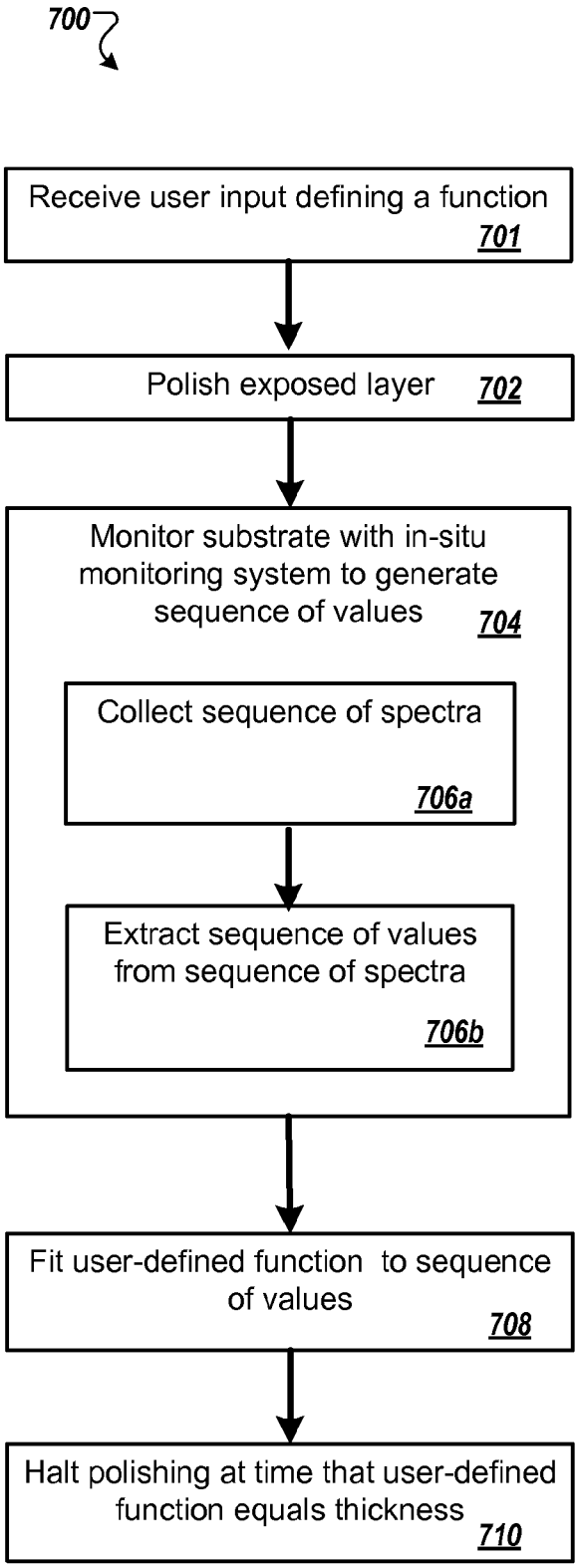
FIG. 5 is a flow diagram of an example process for controlling a polishing operation.

FIG. 5 shows a flow chart of a method 700 of polishing a product substrate. The controller receives input from a user defining a function (step 701). The product substrate is polished (step 702), and a sequence of values are generated by the in-situ monitoring system (step 704). For example, the in-situ monitoring system can collect a sequence of spectra (step 706*a*), and the sequence of values can be extracted from the sequence of spectra (step 706*b*), e.g., using any of the techniques described above. The user-defined function is fit to the sequence of values (step 708).

The time at which the user-defined function will equal the target value can be calculated. Polishing can be halted at the time that user-defined function equals a target value (step 710). For example, in the context of thickness as the endpoint parameter, the time at which the user-defined function will equal the target thickness can be calculated. The target thickness TT can be set by the user prior to the polishing operation and stored. Alternatively, a target amount to remove can be set by the user, and a target thickness TT can be calculated from the target amount to remove (see FIG. 4).

It is possible to generate a sequence of values for different zones of the substrate, and use the sequences from different zones to adjust the pressure applied in the chambers of the carrier head to provide more uniform polishing, e.g., using techniques described in U.S. application Ser. No. 13/096,777, incorporated herein by reference (in general, the position value can be substituted for the index value to use similar techniques). In some implementations, the sequence of values is used to adjust the polishing rate of one or more zones of a substrate, but another in-situ monitoring system or technique is used to detect the polishing endpoint.

In addition, although the discussion above assumes a rotating platen with a sensor of the in-situ monitoring system installed in the platen, system could be applicable to other types of relative motion between the sensor of the monitoring system and the substrate. For example, in some implementations, e.g., orbital motion, the sensor traverses different positions on the substrate, but does not cross the edge of the substrate. In such cases, measurements can be collected at a certain frequency, e.g., 1 Hz or more.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A method of controlling polishing, comprising:

in a computer system coupled to a polishing system and configured to control the polishing system, receiving input from a user of the polishing system through a graphical user interface selecting a function, the function including at least one parameter that can be varied;

polishing a substrate;

monitoring the substrate during polishing with an in-situ monitoring system;

generating a sequence of values from measurements from the in-situ monitoring system;

fitting the function to the sequence of values, the fitting including determining a value of the at least one parameter that provides a best fit of the function to the sequence of values;

determining a projected time at which the function equals a target value; and determining at least one of a polishing endpoint or an adjustment for a polishing rate based on the projected time.

2. The method of claim 1, wherein receiving input from the user comprises receiving user input selecting at least one constant in the function.

3. The method of claim 1, comprising converting textual input to a mathematical function.

4. The method of claim 1, wherein receiving input from the user comprises receiving a user selection from a predetermined set of discrete mathematical functions.

5. The method of claim 4, wherein receiving input from the user comprises receiving a plurality of user selections from the predetermined set of discrete mathematical functions to provide the function.

6. The method of claim 5, wherein the predetermined set of discrete mathematical functions comprises one or more of polynomial, exponential, summation, or trigonometric functions.

7. The method of claim 1, wherein the in-situ monitoring system comprises an optical monitoring system.

8. The method of claim 7, wherein the in-situ monitoring system comprises a spectrographic monitoring system.

9. The method of claim 8, wherein the measurements comprise a sequence of measured spectra.

10. The method of claim 9, wherein generating the sequence of values comprises identifying a matching reference spectrum from a library of reference spectra, and determining a value associated with the matching reference spectrum.

11. The method of claim 9, wherein generating the sequence of values comprises identifying a peak or valley in each spectrum of the sequence of measured spectra and determining a value of a width or wavelength of the peak or valley for each spectrum of the sequence of measured spectra.

12. The method of claim 9, wherein generating the sequence of values comprises fitting an optical model to each measured spectrum from the sequence of measured spectra, the fitting of the optical model including determining of a value of a parameter of the optical model to provide a best fit of an output spectrum of the model to the measured spectrum.

13. The method of claim 8, wherein the measurements comprise a sequence of measured spectra.

14. The method of claim 13, wherein the instructions to generate the sequence of values comprises instructions to one or more of i) identify a matching reference spectrum from a library of reference spectra, and determine a value associated with the matching reference spectrum, ii) identify a peak or valley in each spectrum of the sequence of measured spectra and determine a value of a width or wavelength of the peak or valley for each spectrum of the sequence of measured spectra, or iii) fit an optical model to each measured spectrum from the sequence of measured spectra, the instructions to fit including instructions to determine of a value of a parameter of the optical model to provide a best fit of an output spectrum of the model to the measured spectrum.

15. A computer program product, tangibly embodied in a non-transitory machine readable storage device, comprising instructions to cause a processor to:

receive input, in a computer system coupled to a polishing system and configured to control the polishing system, from a user of the polishing system through a graphical user interface selecting a function, the function including at least one parameter that can be varied;

receive measurements of a substrate from an in-situ monitoring system during polishing;

generate a sequence of values from the measurements from the in-situ monitoring system;

fit the function to the sequence of values, the fitting including determining a value of the at least one parameter that provides a best fit of the function to the sequence of values;

determine a projected time at which the function equals a target value; and determine at least one of a polishing endpoint or an adjustment for a polishing rate based on the projected time.

16. The computer program product of claim 15, wherein the instructions to receive input from the user comprise instructions to receive user input selecting at least one constant in the function.

17. The computer program product of claim 15, wherein the instructions to receive input from the user comprise instructions to receive a user selection from a predetermined set of discrete mathematical functions.

18. The computer program product of claim 17, wherein the instructions to receive input from the user comprise instructions to receive a plurality of user selections from the predetermined set of discrete mathematical functions to provide the function.

19. The computer program product of claim 18, wherein the predetermined set of discrete mathematical functions comprises one or more of polynomial, exponential, summation, or trigonometric functions.

20. A chemical mechanical polishing system, comprising:

a platen to support a polishing pad;

a carrier head to hold a substrate in contact with the polishing pad;

a motor to generate motion between the platen and the carrier head;

an in-situ monitoring system to generate measurements of the substrate during polishing; and a controller configured to receive input from a user of the polishing system through a graphical user interface selecting a function, the function including at least one parameter that can be varied, receive the measurements from the in-situ monitoring system, generate a sequence of values from the measurements from the in-situ monitoring system, fit the function to the sequence of values, the fitting including determining a value of the at least one parameter that provides a best fit of the function to the sequence of values, determine a projected time at which the function equals a target value, and determine at least one of a polishing endpoint or an adjustment for a polishing rate based on the projected time.

* * * * *